US010519922B2

(12) United States Patent
Cartwright et al.

(10) Patent No.: US 10,519,922 B2
(45) Date of Patent: Dec. 31, 2019

(54) METHOD AND SYSTEM FOR IGNITION COIL CONTROL

(71) Applicant: Ford Global Technologies, LLC, Dearborn, MI (US)

(72) Inventors: Justin Cartwright, Ann Arbor, MI (US); Kirk Pulay, Belleville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 16/156,567

(22) Filed: Oct. 10, 2018

(65) Prior Publication Data

US 2019/0040838 A1 Feb. 7, 2019

Related U.S. Application Data

(62) Division of application No. 15/359,395, filed on Nov. 22, 2016, now Pat. No. 10,138,862.

(51) Int. Cl.

| | |
|---|---|
| ***F02P 5/00*** | (2006.01) |
| ***F02P 9/00*** | (2006.01) |
| ***F02P 3/045*** | (2006.01) |

(52) U.S. Cl.

CPC ..... *F02P 9/00* (2013.01); *F02P 3/0456* (2013.01)

(58) Field of Classification Search

CPC ... F02D 37/02; F02P 5/04; F02P 5/045; F02P 5/145; F02P 5/15; F02P 5/14; F02P 3/045; F02P 3/0453; F02P 3/0853; F02P 3/02

USPC ..... 123/406.11, 406.12, 406.26, 406.49, 123/406.53, 406.55, 609, 625, 629, 650

See application file for complete search history.

(56) References Cited

U.S. PATENT DOCUMENTS

| | | | | |
|---|---|---|---|---|
| 5,043,900 | A | 8/1991 | Allen et al. | |
| 5,146,907 | A * | 9/1992 | Sawazaki | F02P 3/051 123/644 |
| 5,913,302 | A | 6/1999 | Ruman et al. | |
| 6,758,176 | B2 * | 7/2004 | Wada | F01L 1/34 123/90.15 |
| 7,686,000 | B2 * | 3/2010 | Garrard | F02P 3/053 123/609 |
| 9,052,241 | B2 | 6/2015 | Barbaza | |
| 9,194,269 | B2 | 11/2015 | Axe et al. | |
| 2007/0215101 | A1 | 9/2007 | Russell et al. | |
| 2007/0215104 | A1 | 9/2007 | Hahn | |
| 2010/0030510 | A1 | 2/2010 | Koehler et al. | |
| 2011/0144881 | A1 | 6/2011 | Glugla et al. | |
| 2017/0058855 | A1 | 3/2017 | Nakamura | |

FOREIGN PATENT DOCUMENTS

| | | | |
|---|---|---|---|
| WO | 2014170110 | A1 | 10/2014 |

* cited by examiner

*Primary Examiner* — John Kwon

(74) *Attorney, Agent, or Firm* — Geoffrey Brumbaugh McCoy Russell LLP

(57) ABSTRACT

Methods and systems are provided for determining an ignition coil dwell time based on an estimated ignition coil temperature. In one example, a method may include estimating the ignition coil temperature based on heat transfer between engine and the ignition coil, heat transfer between ambient and the ignition coil, and internal resistive heating of the ignition coil.

6 Claims, 5 Drawing Sheets

METHOD AND SYSTEM FOR IGNITION COIL CONTROL

CROSS REFERENCE TO RELATED APPLICATION

The present application is a divisional of U.S. patent application Ser. No. 15/359,395, entitled "METHOD AND SYSTEM FOR IGNITION COIL CONTROL," filed on Nov. 22, 2016. The entire contents of the above-referenced application are hereby incorporated by reference in its entirety for all purposes.

FIELD

The present description relates generally to methods and systems for controlling current charged to an ignition coil by determining a dwell time based on an estimation of the ignition coil temperature.

BACKGROUND/SUMMARY

Combustion in an internal combustion engine may be initiated with an ignition spark generated from a spark plug. The ignition spark may be initiated by charging an ignition coil with a low voltage battery. The duration of the charging, or the dwell time, can determine the amplitude of the ignition coil current, and consequently the energy of the ignition spark. The energy of the ignition spark directly affects engine performance. For example, an ignition spark with lower than desired level of energy may cause unreliable combustion or misfire. On the other hand, an ignition spark with higher than the desired level of energy may increase wear of the ignition system.

Other attempts to address the issue of ignition coil control include control of the ignition dwell time based on engine operating parameters. One example approach is shown by Ruman et al. in U.S. Pat. No. 5,913,302A. Therein, ignition dwell time is determined based on engine speed and engine load.

However, the inventors herein have recognized potential issues with such systems. As one example, ignition coil temperature may affect the ignition spark energy. Variation in the ignition coil temperature may cause fluctuation in the electrical circuit resistance, which in turn may affect the ignition coil current. Therefore, in order to accurately control the ignition coil current, the dwell time may be determined based on the ignition coil temperature.

In one example, the issues described above may be addressed by a method of charging an ignition coil for a dwell time determined based on each and every of an engine temperature, an ambient temperature, and a dwell time of the most recent spark ignition. In this way, the ignition coil current may be accurately controlled by taking account of the variation in ignition coil temperature.

As one example, an ignition coil is charged with a dwell time determined based on the ignition coil temperature, wherein the ignition coil temperature may be iteratively updated with an estimated change rate of the coil temperature (e.g., coil temperature change over time, with a unit such as degrees per second). Since the ignition coil is mechanically coupled to the cylinder head, and is exposed to ambient air, the change rate of the coil temperature depends on heat transfer from the engine and the ambient air. Further, current flow within the ignition coil may heat the ignition coil internally. Thus, the change rate of the coil temperature may be calculated in real time by a controller based on each and every of an estimated heat transfer from the engine, internal resistive heating, and heat transfer from ambient air. The internal resistive heating of the ignition coil may be calculated based on the ignition coil temperature from the most recent spark ignition. The ignition coil temperature may be updated with a period shorter than the thermal time constant of the ignition coil, so that the estimated ignition coil temperature may closely track the actual coil temperature. By taking account of the heat transfer to and from the ignition coil, variation in the ignition coil temperature may be accurately tracked at any time point during engine operation without extra equipment installation. As such, the dwell time may be determined before each engine firing event based on the ignition coil temperature and an available battery voltage. In this way, the charge current in the ignition coil may be accurately controlled.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
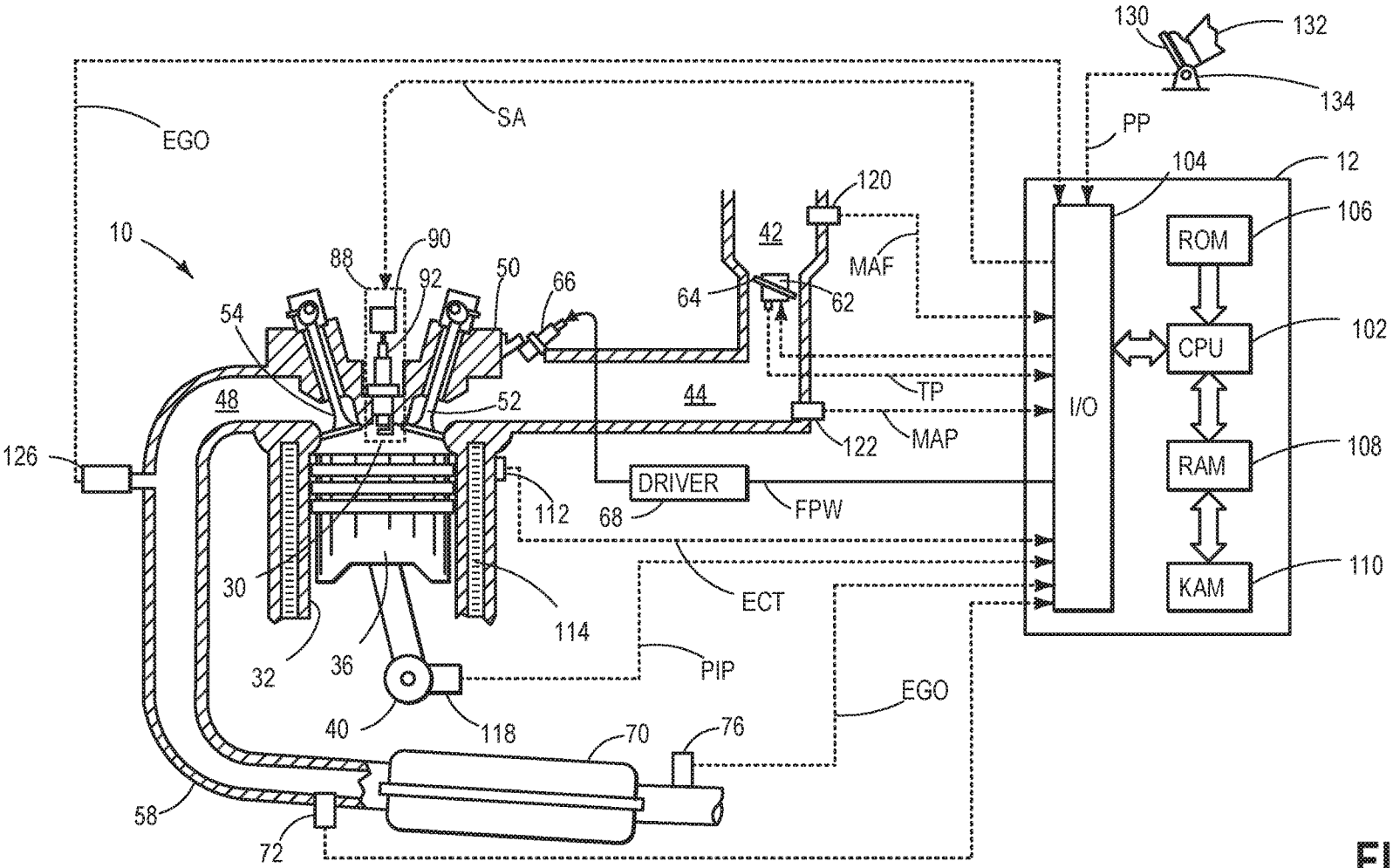
FIG. 1 shows a schematic diagram of an example cylinder of a multi-cylinder internal combustion engine.
Figure 2:
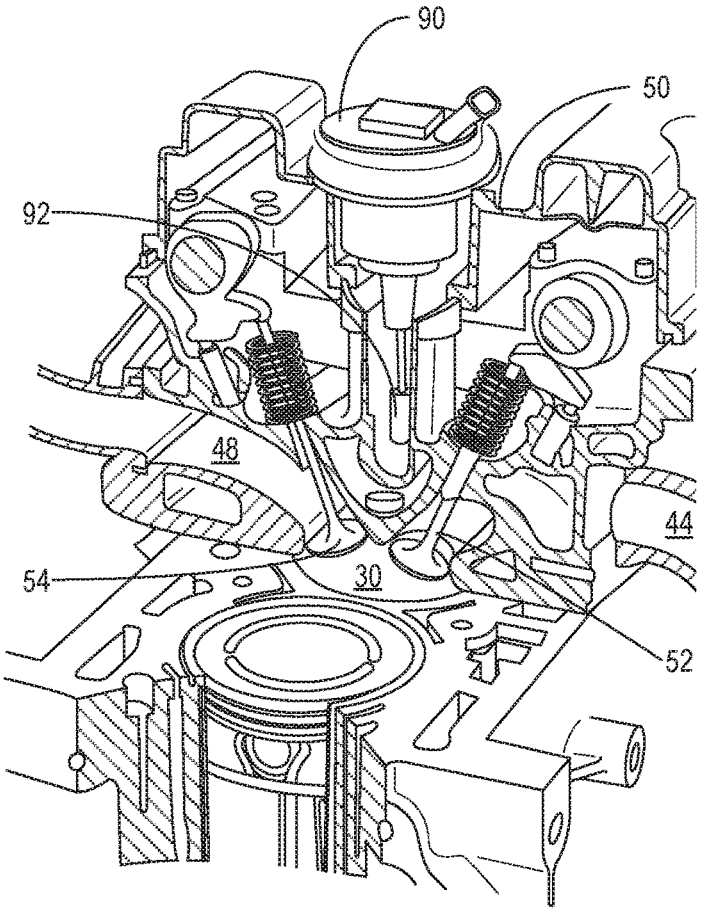
FIG. 2 is a partial view of the engine cylinder showing an ignition system coupled to the engine.
Figure 3:
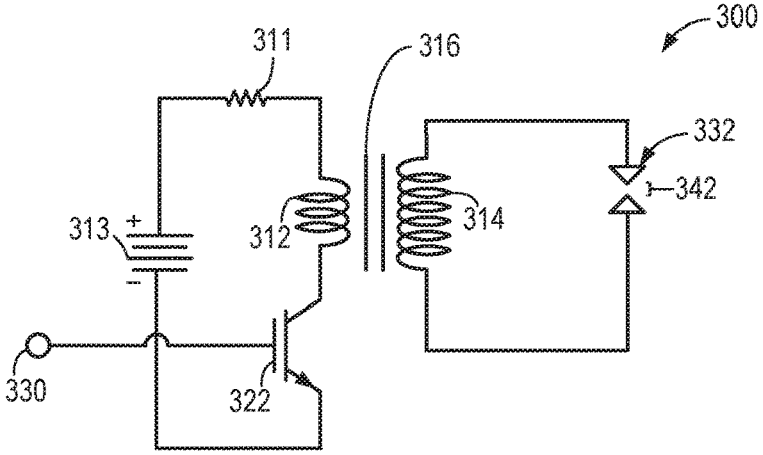
FIG. 3 shows a simplified electrical circuit of the ignition system.
Figure 4:
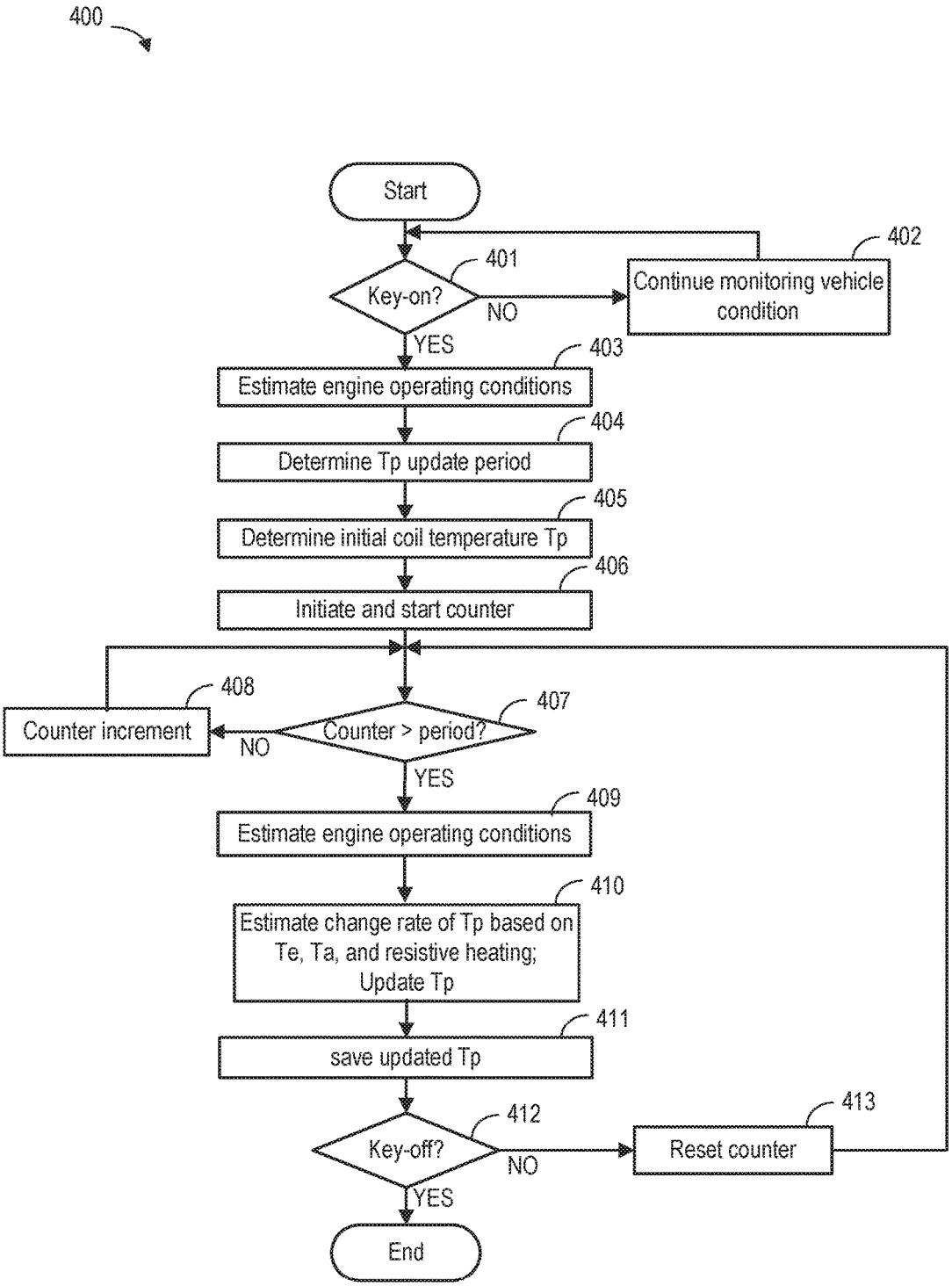
FIG. 4 shows an example method for estimating an ignition coil temperature during engine operation.
Figure 5:
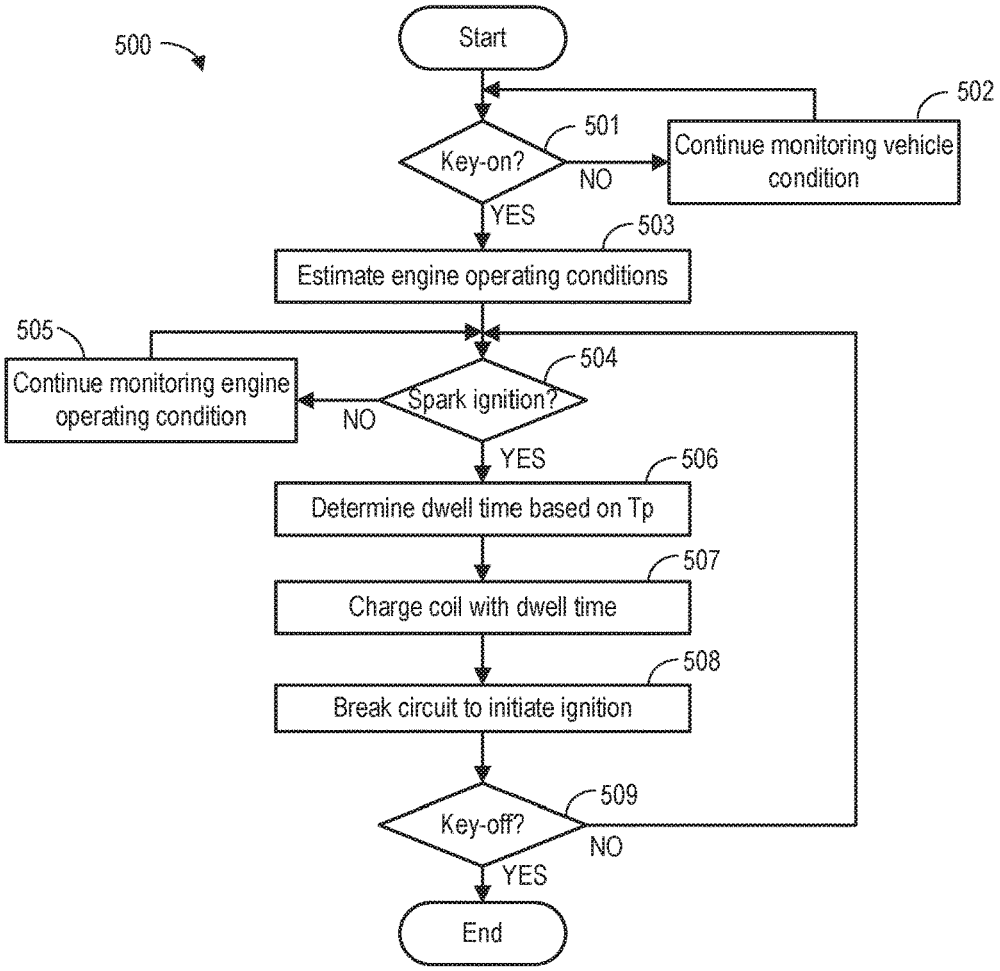
FIG. 5 shows an example method for determining a dwell time.
Figure 6:
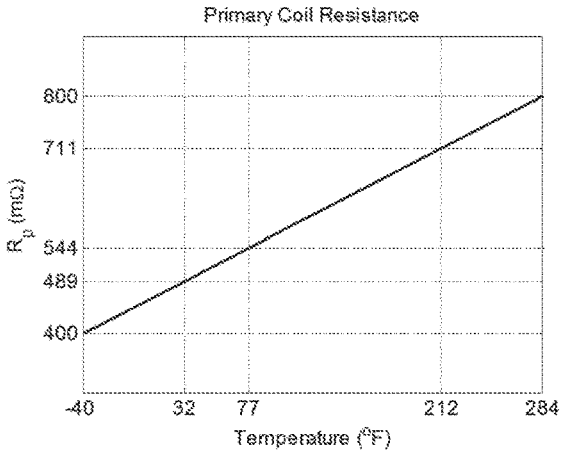
FIG. 6 shows an example relationship between primary coil resistance and the ignition coil temperature.
Figure 7:
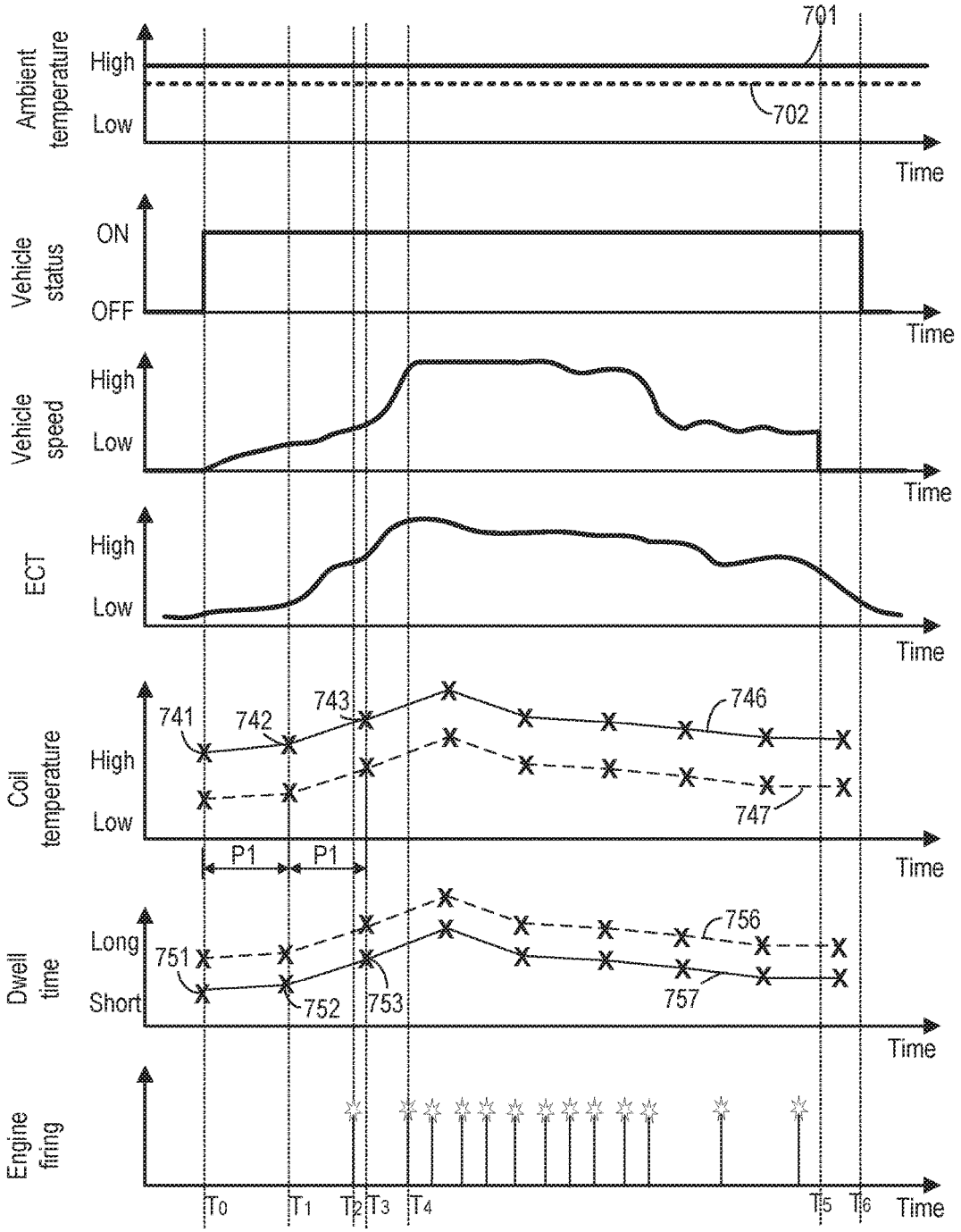
FIG. 7 shows timelines illustrating the variations of representative engine operating parameters over time while implementing the example methods.

The following description relates to systems and methods for controlling current charged to an ignition coil coupled to an internal combustion engine system. An example of the internal combustion engine system is shown in FIG. 1. FIG. 2 is a partial view of the engine system, showing the location of an ignition system within the engine system. The ignition system may include ignition coil and a spark plug. FIG. 3 shows a simplified diagram of an electrical circuit of the ignition system. The electrical circuit includes a primary coil, a battery, and a secondary coil. By coupling the primary coil with a battery for a dwell time, a charge current may build up and flow through the primary coil. Amplitude of the current depends on the ignition coil temperature. FIG. 4 shows an example method of estimating the ignition coil temperature during engine operation. FIG. 5 further shows an example method of determining the dwell time based on the estimated ignition coil temperature. The ignition coil temperature is estimated iteratively based on heat exchanges between the ignition coil and the surroundings. While charging the ignition coil, heat may generated through resistive heating. The resistive heating depends on the primary coil resistance, which in turn depends on the ignition coil temperatures. FIG. 6 shows an example relationship between the ignition coil resistance and the ignition coil temperature. FIG. 7 illustrates variation of representative parameters over time while implementing the example methods shown in FIGS. 4-5.

Turning to FIG. 1, a schematic diagram showing one cylinder of multi-cylinder engine 10, which may be included in a propulsion system of a vehicle, is shown. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber 30 (also termed, cylinder 30) of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system (not shown). Further, a starter motor may be coupled to crankshaft 40 via a flywheel (not shown) to enable a starting operation of engine 10.

Combustion chamber 30 may receive intake air from intake manifold 44 via intake passage 42 and may exhaust combustion gases via exhaust manifold 48. Intake manifold 44 and exhaust manifold 48 can selectively communicate with combustion chamber 30 via respective intake valve 52 and exhaust valve 54. In some embodiments, combustion chamber 30 may include two or more intake valves and/or two or more exhaust valves.

Fuel injector 66 is shown arranged in intake manifold 44 in a configuration that provides what is known as port injection of fuel into the intake port upstream of combustion chamber 30. Fuel injector 66 may inject fuel in proportion to the pulse width of signal FPW received from controller 12 via electronic driver 68. Fuel may be delivered to fuel injector 66 by a fuel system (not shown) including a fuel tank, a fuel pump, and a fuel rail. In some embodiments, combustion chamber 30 may alternatively or additionally include a fuel injector coupled directly to combustion chamber 30 for injecting fuel directly therein, in a manner known as direct injection.

Intake passage 42 may include a throttle 62 having a throttle plate 64. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP. Intake passage 42 may include a mass air flow sensor 120 and a manifold air pressure sensor 122 for providing respective signals MAF and MAP to controller 12.

Ignition system 88 can provide an ignition spark to combustion chamber 30 in response to spark advance signal SA from controller 12. The ignition system may include ignition coil 90 and spark plug 92. An ignitor (not shown in FIG. 1) may be controlled by controller 12 for adjusting the spark timing.

FIG. 2 is a partial view of the engine system, demonstrating the location of the ignition system within the engine system. Ignition coil 90 is mechanically and electrically coupled to one end of spark plug 92. The other end of spark plug 92 is within cylinder chamber 30. The ignition system is mechanically coupled to cylinder head 50. As such, heat exchange may occur between the ignition coil and the cylinder head. Further, since a portion of ignition coil 90 is exposed to ambient air, heat exchange also occurs between the ignition coil and the ambient air. Moreover, internal resistive heating may increase ignition coil temperature while charging the coil. Details about how the coil temperature is affect by heat transfers are disclosed in detail in FIG. 4.

Exhaust gas sensor 126 is shown coupled to exhaust passage 58 upstream of emission control device 70. Sensor 126 may be any suitable sensor for providing an indication of exhaust gas air-fuel ratio such as a linear oxygen sensor or UEGO (universal or wide-range exhaust gas oxygen), a two-state oxygen sensor or EGO, a HEGO (heated EGO), a NOx, HC, or CO sensor. Emission control device 70 is shown arranged along exhaust passage 58 downstream of exhaust gas sensor 126. Device 70 may be a three way catalyst (TWC), NOx trap, various other emission control devices, or combinations thereof. In some embodiments, during operation of engine 10, emission control device 70 may be periodically reset by operating at least one cylinder of the engine within a particular air/fuel ratio. Full-volume exhaust gas sensor 76 is shown coupled to exhaust passage 58 downstream of emission control device 70. Sensor 76 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Further, a plurality of exhaust gas sensors may be located at partial volume locations within the emission control devices. As an example, the embodiment may include a mid-bed sensor to detect air-fuel ratio in the middle of the catalyst.

Other sensors 72 such as an air mass flow (AM) and/or a temperature sensor may be disposed upstream of emission control device 70 to monitor the AM and temperature of the exhaust gas entering the emission control device. The sensor locations shown in FIG. 1 are just one example of various possible configurations. For example, the emission control system may include a partial volume set-up with close coupled catalysts.

Controller 12 is shown in FIG. 1 as a microcomputer, including microprocessor unit 102, input/output ports 104, an electronic storage medium for executable programs and calibration values shown as read only memory 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; airmass and/or temperature of the exhaust gas entering the catalyst from sensor 72; exhaust gas air-fuel ratio post-catalyst from sensor 76; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses for each revolution of the crankshaft. Additionally, controller 12 may communicate with a cluster display device, for example to alert the driver of faults in the engine or exhaust after-treatment system.

The controller 12 receives signals from the various sensors of FIG. 1 and employs the various actuators of FIG. 1 to adjust engine operation based on the received signals and instructions stored on a non-transitory memory of the controller. For example, adjusting ignition spark timing may include adjusting the ignitor of the ignition system to adjust the timing to charge and discharge the ignition coil.

FIG. 3 shows an example electric circuit 300 of the ignition system. The ignition system may include an ignition coil and a spark plug. The ignition coil may include a primary coil 312 and a secondary coil 314. The coils are magnetically coupled and arranged as a transformer with the primary coil and the secondary coil having a shared core 316. In some examples, core 316 includes a ferromagnetic material, such as steal. In other examples, core 316 may include a ferrimagnetic material, such as ceramic. The coils are magnetically coupled; a changing current in one coil electro-dynamically induces current in the other coil. Further, primary coil 312 has a first number of windings and the secondary coil 314 has a second number of windings greater than the first number of windings, so that voltage is "stepped-up" between the two coils.

Primary coil 312 is electrically coupled to a voltage source, in the present example a battery 313. Resistance of the primary coil circuit is represented by resistor 311. Resistor 311 may include primary coil resistance and harness resistance. Primary coil 312 is further coupled to an igniter 322. Igniter 322 may be open or closed by signal received at terminal 330. When the igniter is closed, battery 313 charges primary coil 312, and a charge current is built up within the primary coil. Duration of the charging is referred as the ignition coil dwell time. In response to the charge current reaches a desired value after the dwell time, igniter 322 opens. Due to the sudden loss of current in the primary coil, high voltage across spark plug gap 342 induces an ignition spark. Herein, current in the primary coil is also referred to as ignition coil current. Charge current flowing through resistor 311 may generate heat and increase the ignition coil temperature. Further, the ignition coil temperature may also be affected due to heat transfer from engine and ambient air.

FIG. 4 shows an example method 400 for estimating the ignition coil temperature. After initiation, the ignition coil temperature is iteratively updated based on heat transfer from the engine to the ignition coil, heat transfer from ambient to the ignition coil, and internal resistive heating generated while charging the ignition coil.

Instructions for carrying out method 400 and the rest of the methods included herein may be executed by a controller based on instructions stored on a memory of the controller and in conjunction with signals received from sensors of the engine system, such as the sensors described above with reference to FIG. 1. The controller may employ engine actuators of the engine system to adjust engine operation, according to the methods described below.

At 401, method 400 determines whether the vehicle is in operation. For example, the vehicle may be considered in operation responsive to a key-on event. If the vehicle is OFF, method 400 continues monitoring vehicle condition at 402. Otherwise, method 400 goes to 403.

At 403, engine operating conditions may be determined by the controller when the vehicle is in operation. The controller acquires measurements from various sensors in the engine system and estimates operating conditions such as engine temperature and ambient temperature.

At 404, method 400 determines a period for updating the ignition coil temperature $T_p$. As an example, the period for updating the ignition coil temperature may be shorter than a thermal time constant of the ignition coil. In another example, the period for updating the ignition coil may be predetermined and saved in the memory of the controller. The thermal time constant for the ignition coil can be on the order of seconds. As an example, a 100 ms task rate may be used as the updating period.

At 405, initial ignition coil temperature is estimated based on a pre-determined calibration method. For example, the ignition coil temperature may be initialized based on the engine temperature and the ambient temperature determined at 403. The engine temperature may for example be estimated based on engine coolant temperature. The ignition coil temperature may be calculated according to Equation 1:

$$T_{p(0)}=C_4+C_5T_aC_6T_e, \qquad \text{Equation 1}$$

where $T_p$ is primary coil temperature, herein also referred to as ignition coil temperature; $T_a$ is ambient temperature; $T_e$ is engine temperature; and $C_4$, $C_5$, and $C_6$ are pre-determined calibration coefficients.

At 406, method 400 initiates and starts a counter from zero.

At 407, the controller checks whether the counter has exceeded the $T_p$ updating period. If the answer is YES, method 400 goes to 409. If the answer is NO, method 400 increases the counter at 408.

At 409, current engine operating conditions are estimated. The controller may estimate parameters including engine speed, engine temperature, vehicle speed and ambient temperature from various sensors.

At 410, method 400 calculates a change rate of the ignition coil temperature based on the engine temperature, the ambient temperature, and the internal resistive heating. Method 400 further updates the ignition coil temperature based on the calculated change rate. Since the ignition coil is mechanically coupled to cylinder head, and is physically exposed to ambient air, the thermal energy in the primary coil may be affected by heat transfer from the engine and the ambient. Further, the thermal energy in the primary coil may be affected by internal resistive heating during charging of the ignition coil. The change rate of the thermal energy may be expressed as:

$$\frac{dQ_p}{dt} = q_e + q_a + P_p, \qquad \text{Equation 2}$$

where $Q_p$ is the thermal energy in the primary coil, herein also referred to the thermal energy in the ignition coil; $q_e$ is the thermal energy due to heat transfer from the engine; $q_a$ is the thermal energy due to heat transfer from ambient; and $P_p$ is the thermal energy due to internal heating. Base on Equation 2, the change rate of the ignition coil temperature may be calculated as follows:

$$\frac{dT_p}{dt} = C_0(T_e - T_p) + C_1(T_a - T_p) + \qquad \text{Equation 3}$$

-continued $$C_2S_v(T_a - T_p) + C_3F(\overline{I_p}\Delta tN)^2R_p,$$

where $T_e$ and $T_a$ are current engine temperature ambient temperature estimated from 411; $\overline{I_p}$ is an averaged dwell period current in the primary coil; $\Delta t$ is the dwell time for the most recent ignition; N is the engine speed; $R_p$ is the primary coil resistance; $S_v$ is the vehicle speed; and $C_0$, $C_1$, $C_2$, and $C_3$ are pre-determined calibration constants. The parameter F relates to engine firing. If the engine is not firing, F=0; if the engine is firing, F=1. As such, the change rate of ignition coil temperature (degrees per second) increases with increased difference between the engine temperature and the ignition coil temperature, and increases with increased difference between the ambient temperature and the ignition coil temperature. Increased vehicle speed may increase the change rate of ignition coil temperature due to increased convective heat transfer.

Internal resistive heating accounts to heat generated during the most recent ignition coil charging. In the simplified primary coil circuit diagram shown in FIG. 3, primary coil current may be expressed by solving circuit equation:

$$R_tI_p + L_p\frac{dI_p}{dt} = V_b, \quad \text{Equation 4}$$

wherein $R_t$ is the total circuit resistance; $I_p$ is the primary coil current, herein also referred to as the ignition coil current; $L_p$ is the inductive of the primary coil; and $V_b$ is the battery voltage. Solving $I_p$ from Equation 4, we may get:

$$I_p(t) = \frac{V_b}{R_t}\left(1 - e^{\frac{-tR_t}{L_p}}\right). \quad \text{Equation 5}$$

The averaged dwell period current during the most recent charging may be calculated with:

$$\overline{I_p} = \frac{V_b}{R_t\Delta t}\left(\Delta t + \frac{L_p}{R_t}\left(e^{\frac{-\Delta tR_t}{L_p}} - 1\right)\right). \quad \text{Equation 6}$$

The total circuit resistance $R_t$ depends on the ignition coil temperature. $R_t$ may be expressed as the sum of the primary coil resistance $R_p$ and the harness resistance $R_h$:

$$R_t = R_p + R_h. \quad \text{Equation 7}$$

The harness resistance does not change significantly with the ignition coil temperature, thus may be pre-determined during calibration. The primary coil resistance may be determined based on the estimated ignition coil temperature. As an example, controller may read the ignition coil temperature saved in the memory, and determine the primary coil resistance by checking a pre-determined lookup table. FIG. 6 shows an example relationship between the primary coil resistance and the ignition coil temperature. The primary coil resistance increases monotonically with increased ignition coil temperature. Such relationship may be provided by the manufacturer of the ignition coil.

Method 400 updates the ignition coil temperature based on the coil temperature estimated during previous iteration and a time duration from last spark ignition to current coil temperature update. As an example, the ignition coil temperature may be updated by weighting the change rate of the ignition coil temperature with the time duration from the most recent spark ignition:

$$T_{p(i+1)} = T_{p(i)} + \left(\frac{dT_p}{dt}\right)_i \Delta t_{(i)}, \quad \text{Equation 8}$$

wherein i denotes the number of iterations; $T_{p(i+1)}$ denotes the updated coil temperature; $T_{p(i)}$ denotes the coil temperature from previous iteration; and $\Delta t_{(i)}$ denotes the time passed from the most recent estimation of the ignition coil temperature. As an example, the $\Delta t_{(i)}$ may set to be the update period of the estimated ignition coil temperature at 404.

At 411, method 400 saves the updated ignition coil temperature in the memory.

At 412, method 400 checks whether the vehicle is operating. If the vehicle stops operating, e.g., key-off, method 400 ends. Otherwise, method 400 reset the counter to zero at 415 and continue estimating the ignition coil temperature.

FIG. 5 shows method 500 for charging the ignition coil based on the estimated ignition coil temperature. Method 500 runs in parallel with method 400, and utilizes the latest ignition coil temperature estimation from method 400 for determining the dwell time.

At 501, method 500 determines whether the vehicle is in operation. For example, method 500 determines the vehicle is in operation in response to a key-on event. If the vehicle is OFF, method 400 continues monitoring the vehicle condition at 502. Otherwise, method 500 goes to 503.

At 503, controller (such as controller 12 in FIG. 1) estimates engine operating conditions based on the readings from various sensors in the engine system. The operating conditions may include engine speed, engine load, engine coolant temperature, the amount of available fuel, and fuel composition.

At 504, the controller determines whether the spark ignition should be initiated. As an example, the controller may determine to start spark ignition once the engine start running. As another example, the controller may determine to start spark ignition responsive to the engine speed higher than a threshold. The controller may determine to start spark ignition based on a spark retardation. The spark retardation may be determined based on engine operating conditions including engine speed, engine load, engine temperature, and fuel conditions. If the controller determines not to initiate the ignition spark, method 500 moves to 505, wherein the controller continues to monitor engine operating conditions. Otherwise, method 500 goes to 506.

At 506, method 500 determines dwell time of the ignition coil based on the ignition coil temperature. As an example, the controller may load current estimation of the ignition coil temperature from the memory. The controller may also determine an available battery voltage. Then, the dwell time may be determined based on the loaded ignition coil temperature and the battery voltage via a pre-calibrated lookup table.

Alternatively, the controller may determine the dwell time every time the ignition coil temperature is estimated. When the ignition spark needs to be generated, the controller charges the primary coil with the determined dwell time.

At 507, the primary coil may be charged with the dwell time. As an example, the igniter (such as igniter 322 in FIG. 3) may be closed for a duration equal to the dwell time.

Upon stopping the primary coil charging and breaking the primary coil circuit at 508, an ignition spark is generated in the combustion chamber.

At 509, the controller detects whether the vehicle stops operation. The vehicle operation may be determined stopped in response to a key-off event. If the vehicles is running, method 500 goes to 504. Otherwise, method 500 ends.

Turning to FIG. 7, variation of engine operating parameters while implementing methods 400 and 500 are presented. The x-axes are time, and increase from left to right as indicated by the arrows. The first graph from the top shows ambient temperature. The ambient temperature may be measured by a temperature sensor. The ambient temperature increases as indicated by the y-axis. The second graph from the top shows vehicle status. The vehicle status may be ON or OFF. As an example, the vehicle status may be determined in response to key-on or key-off event. The third graph from the top shows vehicle speed. The vehicle speed increases as indicated by the y-axis. The fourth graph from the top shows engine coolant temperature (ECT). ECT may be measured by a temperature sensor coupled to the cooling circuit. ECT increases as indicated by the y-axis. ECT may be used to estimate engine temperature. The fifth graph from the top shows the estimated ignition coil temperature over time. Each cross indicates the time point when the coil temperature is estimated. The sixth graph from the top illustrates the dwell time calculated based on the ignition coil temperature and the battery voltage. The dwell time herein is calculated responsive to each estimation of the ignition coil temperature. Alternatively, the dwell time may be calculated prior to each spark ignition. The seventh graph from the top shows engine ignition or engine firing event in a cylinder. Each star indicates the generation of an ignition spark.

At $T_0$, the vehicle starts operating. For example, in response to key-on event, the crankshaft starts cranking, and vehicle speed increases from zero speed. The engine coolant temperature may also increase over time. In response to vehicle start, the controller starts to estimate the ignition coil temperature and the dwell time. The initial ignition coil temperature $T_{p(0)}$ 741 may be estimated based on the measured engine temperature and ambient temperature 701 according to Equation 1. The first dwell time 751 is determined based on the first ignition coil temperature 741 and the battery voltage via a lookup table. The coil temperature and dwell time estimated at ambient temperature 701 are shown in 746 and 757. The coil temperature and dwell time estimated at ambient temperature 702 are shown in 747 and 756. With decreased ambient temperature, the estimated coil temperature 746 decreases and the dwell time 756 increases.

At T1, after a time duration of period P1 from $T_0$, ignition coil temperature is updated to $T_{p(1)}$ 742. The period P1 is chosen to be shorter than the thermal time constant of the ignition coil. Since there is no engine firing from engine start at $T_0$, the change rate of the ignition coil temperature may be updated based on Equation 3, with F=0. Alternatively, the initial ignition coil temperature may remain the same as $T_{p(0)}$. Dwell time 752 is calculated based on coil temperature 402 and battery voltage.

At $T_2$, engine starts firing. As an example, the engine may start firing in response to engine speed higher than a threshold. The controller may initiate the first engine firing by charging the ignition coil with a dwell time of 752.

At $T_3$, after duration P1 from the most recent estimation of coil temperature 742, the change rate of ignition coil temperature is calculated. The change rate of the ignition coil temperature may be calculated based on the dwell time for the most recent firing (i.e. dwell time 752) and coil temperature 742 according to Equation 3, with F=1. In other words, the change rate of the ignition coil temperature is calculated based on the most recently determined dwell time 752. Then, the third coil temperature $T_{p(2)}$ 743 may be determined based on the change rate of the ignition coil temperature according to Equation 8. Dwell time 753 is calculated based on coil temperature 743 and battery voltage.

At $T_4$, vehicle speed and engine firing frequency increases. The coil temperature and the dwell time are still updated at the time period P1. As such, the coil temperature and the dwell time are updated at a constant frequency independent from the engine firing frequency. The coil temperature may decrease in response to high vehicle speed, due to increased convection cooling.

At $T_5$, the engine firing is stopped and the vehicle is stopped. In other words, the engine stopped rotating and the vehicle speed is zero. The controller continues estimating the coil temperature and the dwell time. In this way, the estimated dwell time is available during engine restart.

At $T_6$, vehicle stops operating. The controller stops estimating the ignition coil temperature and the dwell time.

In this way, ignition coil temperature may be accurately estimated based on heat transfer from the engine, the ambient air, and the internal resistive heating. The dwell time of the ignition coil may be updated in parallel with the ignition coil temperature estimation. Therefore, charge current and corresponding power of the ignition spark may be accurately controlled.

The technical effect of estimating the ignition coil temperature based on heat transfer is that no temperature sensor is required. The technical effect of estimating the change rate of the ignition coil temperature based on heat transfer from the engine, the ambient air, and the internal resistive heating is that the ignition coil temperature may be accurately estimated. The technical effect of updating the ignition coil temperature at a frequency higher than a minimum frequency is that deviation of the estimated and the actual ignition coil temperature may be avoided. The minimum frequency is the reciprocal of the thermal time constant of the ignition coil. The technical effect of updating the ignition coil temperature at a frequency higher than the engine firing frequency is that heat transfer from the resistive heating generated from each engine firing to the ignition coil may be taken into account.

As one embodiment, a method comprises, charging an ignition coil for a dwell time determined based on each and every of an engine temperature, an ambient temperature, and a dwell time for a most recent spark ignition. In a first example of the method, wherein the dwell time is further determined based on a primary coil resistance. A second example of the method optionally includes the first example and further includes, the primary coil resistance is estimated based on a temperature of the ignition coil. A third example of the method optionally includes one or more of the first and second examples, and further includes, the temperature of the ignition coil is updated at a frequency higher than an engine firing frequency. A fourth example of the method optionally includes one or more of the first through third examples, and further includes, the dwell time is further determined based on a vehicle speed. A fifth example of the method optionally includes one or more of the first through fourth examples, and further includes, the dwell time is increased with increased difference between the engine temperature and an ignition coil temperature. A sixth example of the method optionally includes one or more of the first through fifth examples, and further includes, the dwell time is increased with increased difference between the ambient temperature and an ignition coil temperature.

As another embodiment, a method comprises: estimating an ignition coil temperature; updating the ignition coil temperature based on each and every of heat transfer from an engine to the ignition coil, internal resistive heating of the ignition coil, and heat transfer from ambient to the ignition coil; and charging the ignition coil for a dwell time determined based on the updated ignition coil temperature. In a first example of the method, wherein the internal resistive heating of the ignition coil is estimated based on a most recently determined dwell time, an averaged dwell period current, and a primary coil resistance. A second example of the method optionally includes the first example and further includes, determining an initial ignition coil temperature based on each and every of an engine temperature and an ambient temperature in response to a key-on event. A third example of the method optionally includes one or more of the first and second examples, and further includes, further comprising stop updating the ignition coil temperature in response to a key-off event. A fourth example of the method optionally includes one or more of the first through third examples, and further includes, updating the ignition coil temperature at a frequency independent from an engine firing frequency. A fifth example of the method optionally includes one or more of the first through fourth examples, and further includes, the heat transfer from the engine to the ignition coil is estimated based on an engine temperature and the most recently updated ignition coil temperature. A sixth example of the method optionally includes one or more of the first through fifth examples, and further includes, the heat transfer from ambient to the ignition coil is estimated based on an ambient temperature and the most recently updated ignition coil temperature.

As yet another embodiment, a system comprises: an engine, a spark plug coupled to the engine, an ignition coil coupled to the spark plug, and a controller configured with computer readable instructions stored on non-transitory memory for: periodically update an estimated ignition coil temperature based on a change rate of the ignition coil temperature, wherein the change rate of the ignition coil temperature is a mathematical function of each and every of an engine temperature, an ambient temperature, and a first dwell time for a most recent spark ignition; charging the ignition coil with a second dwell time determined based on the updated estimated ignition coil temperature. In a first example of the system, the controller is further configured for updating the estimated ignition coil temperature based on an averaged dwell period current of the ignition coil. A second example of the system optionally includes the first example and further includes, the controller is further configured to update the estimated ignition coil temperature at a frequency determined based on a thermal time constant of the ignition coil. A third example of the system optionally includes one or more of the first and second examples, and further includes, the controller is further configured to update the estimated ignition coil temperature at a frequency determined based on a vehicle speed. A fourth example of the system optionally includes one or more of the first through third examples, and further includes, the controller is further configured to updated the estimated ignition coil temperature by weighting the change rate of the ignition coil temperature with a time duration from the most recent spark ignition. A fifth example of the system optionally includes one or more of the first through fourth examples, and further includes, the dwell time is determined further based on a battery voltage.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system comprising:

an engine, a spark plug coupled to the engine, an ignition coil coupled to the spark plug, and a controller configured with computer readable instructions stored on non-transitory memory for:

periodically updating an estimated ignition coil temperature based on a change rate of an ignition coil temperature, wherein the change rate of the ignition coil temperature is a mathematical function of each and every one of an engine temperature, an ambient temperature, and a first dwell time for a most recent spark ignition; and charging the ignition coil with a second dwell time determined based on the updated estimated ignition coil temperature.

2. The system of claim 1, wherein the controller is further configured to update the estimated ignition coil temperature based on an averaged dwell period current of the ignition coil.

3. The system of claim 1, wherein the controller is further configured to update the estimated ignition coil temperature at a frequency determined based on a thermal time constant of the ignition coil.

4. The system of claim 1, wherein the controller is further configured to update the estimated ignition coil temperature based on a vehicle speed.

5. The system of claim 1, wherein the controller is further configured to updated the estimated ignition coil temperature by weighting the change rate of the ignition coil temperature with a time duration from a most recent update of the estimated ignition coil temperature.

6. The system of claim 1, wherein the dwell time is determined further based on a battery voltage.

* * * * *